US007879194B2

(12) United States Patent
Quigley

(10) Patent No.: US 7,879,194 B2
(45) Date of Patent: Feb. 1, 2011

(54) STRUCTURED FORMING FABRIC AND METHOD

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 677 days.

(21) Appl. No.: 11/896,843

(22) Filed: Sep. 6, 2007

(65) Prior Publication Data

US 2009/0065167 A1 Mar. 12, 2009

(51) Int. Cl.
*D21F 1/10* (2006.01)
*D03D 11/02* (2006.01)

(52) U.S. Cl. ..... 162/348; 162/116; 162/903; 139/383 A

(58) Field of Classification Search ..... 162/116, 162/348, 902–904; 139/383 A, 383 AA, 139/425 A
See application file for complete search history.

(56) References Cited

U.S. PATENT DOCUMENTS

| | | | | |
|---|---|---|---|---|
| 3,867,766 | A | 2/1975 | Wagner | |
| 4,224,372 | A | 9/1980 | Romanski | |
| 4,239,065 | A | 12/1980 | Trokhan | |
| 4,314,589 | A | 2/1982 | Buchanan et al. | |
| 4,423,755 | A | 1/1984 | Thompson | |
| 4,501,303 | A | 2/1985 | Osterberg | |
| 4,564,052 | A | 1/1986 | Borel | |
| 4,759,391 | A * | 7/1988 | Waldvogel et al. | 139/383 A |
| 4,832,090 | A | 5/1989 | Krenkal et al. | |
| 5,101,866 | A | 4/1992 | Quigley | |
| 5,151,316 | A | 9/1992 | Dukin et al. | |
| 5,152,326 | A | 10/1992 | Vohringer | |
| 5,324,248 | A | 6/1994 | Quigley | |
| 5,343,896 | A | 9/1994 | Schroder et al. | |
| 5,429,686 | A | 7/1995 | Chiu et al. | |
| 5,437,315 | A | 8/1995 | Ward | |
| 5,456,293 | A | 10/1995 | Ostermayer et al. | |
| 5,520,225 | A | 5/1996 | Quigley et al. | |
| 5,542,455 | A | 8/1996 | Ostermayer et al. | |
| 5,555,917 | A | 9/1996 | Quigley | |
| 5,694,980 | A | 12/1997 | Quigley | |
| 5,713,397 | A | 2/1998 | Quigley | |
| 5,731,059 | A | 3/1998 | Smith et al. | |

(Continued)

FOREIGN PATENT DOCUMENTS

| | | |
|---|---|---|
| WO | 02/00996 | 1/2002 |

(Continued)

OTHER PUBLICATIONS

Co-pending U.S. Appl. No. 11/896,847, filed Sep. 6, 2007.

(Continued)

*Primary Examiner*—Eric Hug
(74) *Attorney, Agent, or Firm*—Greenblum & Bernstein, P.L.C.

(57) ABSTRACT

Forming fabric for making a bulky web. The fabric includes a machine facing side and a web facing side comprising pockets formed by warp and weft yarns. A bottom of the pockets is formed by an exchange of the warp and weft yarns. A contact plane of the web facing side includes elongated warp knuckles. This Abstract is not intended to define the invention disclosed in the specification, nor intended to limit the scope of the invention in any way.

42 Claims, 9 Drawing Sheets

U.S. PATENT DOCUMENTS 5,817,213 A 10/1998 Ostermayer et al.
5,826,627 A 10/1998 Seabrook et al.
5,840,411 A 11/1998 Stlljes et al.
5,853,547 A 12/1998 Ahrens et al.
5,945,357 A 8/1999 Quigley
5,967,195 A 10/1999 Ward
5,988,229 A 11/1999 Quigley
6,148,869 A 11/2000 Quigley
6,202,705 B1 3/2001 Johnson et al.
6,227,256 B1 5/2001 Quigley
6,237,644 B1 5/2001 Hay et al.
6,349,749 B1 2/2002 Quigley
6,379,506 B1 * 4/2002 Wilson et al. ..... 162/348
6,530,398 B1 3/2003 Westerkamp
6,546,964 B1 4/2003 Westerkamp
6,581,645 B1 6/2003 Johnson et al.
6,592,714 B2 7/2003 Lamb
6,649,026 B2 11/2003 Lamb
6,763,855 B2 * 7/2004 Rougvie ..... 139/383 A
6,834,684 B2 12/2004 Martin et al.
6,860,299 B2 3/2005 Kuji
6,926,043 B2 8/2005 Quigley et al.
6,953,065 B2 10/2005 Martin et al.
6,959,737 B2 11/2005 Ward
6,978,809 B2 12/2005 Quigley
7,007,722 B2 3/2006 Quigley et al.
7,048,012 B2 5/2006 Martin et al.
7,059,357 B2 6/2006 Ward
7,059,359 B2 6/2006 Quigley et al.
2002/0056536 A1 5/2002 Lamb
2004/0020621 A1 2/2004 Heger et al.
2004/0079434 A1 4/2004 Martin et al.
2004/0182465 A1 9/2004 Ward
2004/0231745 A1 11/2004 Quigley et al.
2004/0238062 A1 12/2004 Quigley et al.
2005/0051230 A1 3/2005 Martin et al.
2005/0067040 A1 3/2005 Quigley
2005/0103397 A1 5/2005 Quigley et al.
2005/0139281 A1 6/2005 Martin et al.
2005/0167066 A1 8/2005 Herman et al.
2006/0009582 A1 1/2006 Zhang et al.
2006/0016505 A1 1/2006 Westerkamp
2006/0016509 A1 1/2006 Westerkamp et al.
2006/0048840 A1 3/2006 Quigley
2006/0060321 A1 3/2006 Quigley et al.
2006/0063451 A1 3/2006 Serr et al.
2006/0085999 A1 4/2006 Scherb et al.
2006/0219312 A1 10/2006 Hay et al.
2006/0243338 A1 11/2006 Hawes et al.
2006/0278294 A1 12/2006 Quigley
2007/0006934 A1 1/2007 Quigley et al.
2007/0006935 A1 1/2007 Quigley et al.
2007/0028994 A1 * 2/2007 Kroll et al. ..... 139/383 R
2007/0028996 A1 2/2007 Quigley
2007/0215304 A1 9/2007 Lippi Alves Fernandes et al.
2007/0240842 A1 10/2007 Scherb et al.
2007/0251659 A1 11/2007 Fernandes et al.
2007/0251660 A1 11/2007 Walkenhaus et al.
2007/0272385 A1 11/2007 Quigley et al.
2008/0236699 A1 * 10/2008 Kroll et al. ..... 139/383 A

FOREIGN PATENT DOCUMENTS

WO 2005/035867 4/2005
WO 2005/075732 8/2005
WO 2005/075737 8/2005
WO 2006/113818 10/2006

OTHER PUBLICATIONS

Co-pending U.S. Appl. No. 11/896,842, filed Sep. 6, 2007.

* cited by examiner

Fig. 1
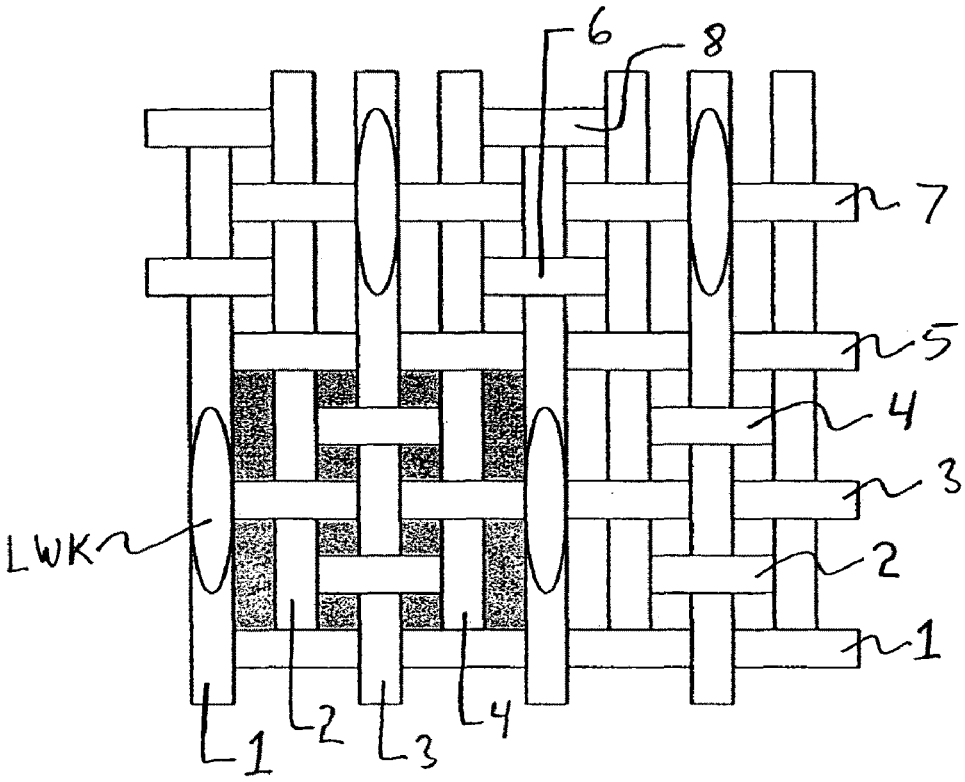
Fig. 2
| | | | | |
|---|---|---|---|---|
| | X | X | X | 8 |
| X | | X | | 7 |
| | X | X | X | 6 |
| X | | X | | 5 |
| X | X | | X | 4 |
| X | | X | | 3 |
| X | X | | X | 2 |
| X | | X | | 1 |
| 1 | 2 | 3 | 4 | |
Fig. 3
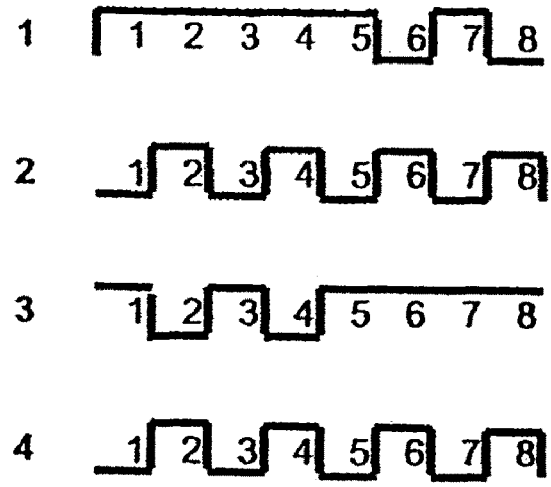

Fig. 7
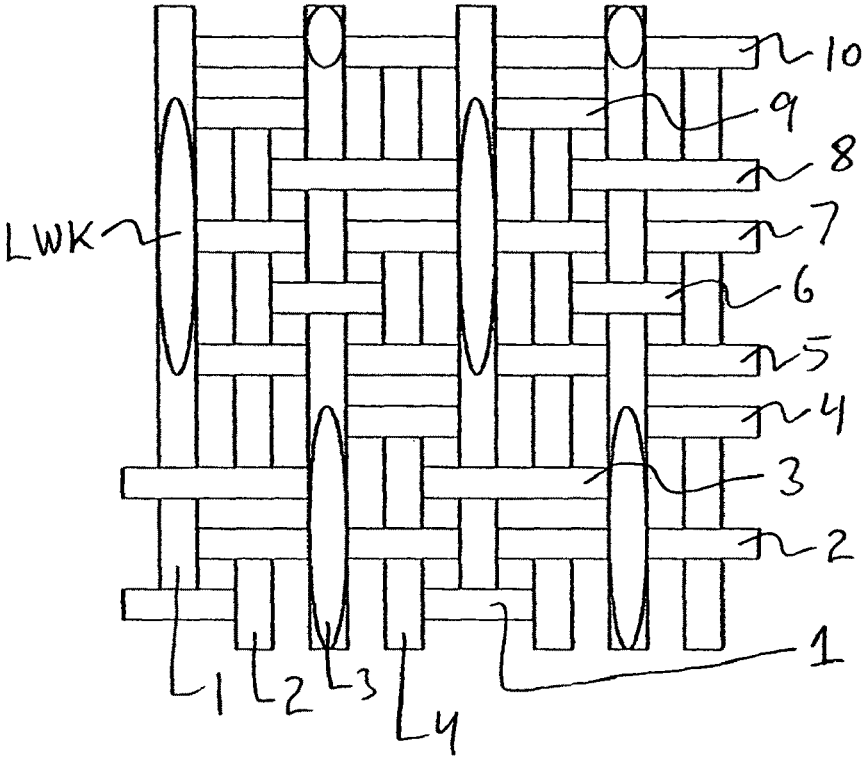
Fig. 8
| | | | | |
|---|---|---|---|---|
| X | | X | | 10 |
| X | | X | X | 9 |
| X | X | | | 8 |
| X | | X | | 7 |
| X | X | | X | 6 |
| X | | X | | 5 |
| X | X | X | | 4 |
| | | X | X | 3 |
| X | | X | | 2 |
| | X | X | X | 1 |
| 1 | 2 | 3 | 4 | |
Fig. 9
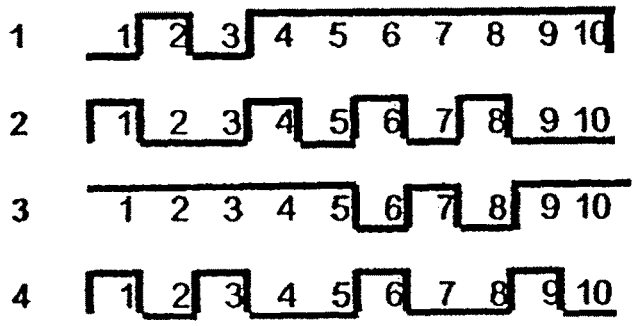

Fig. 13
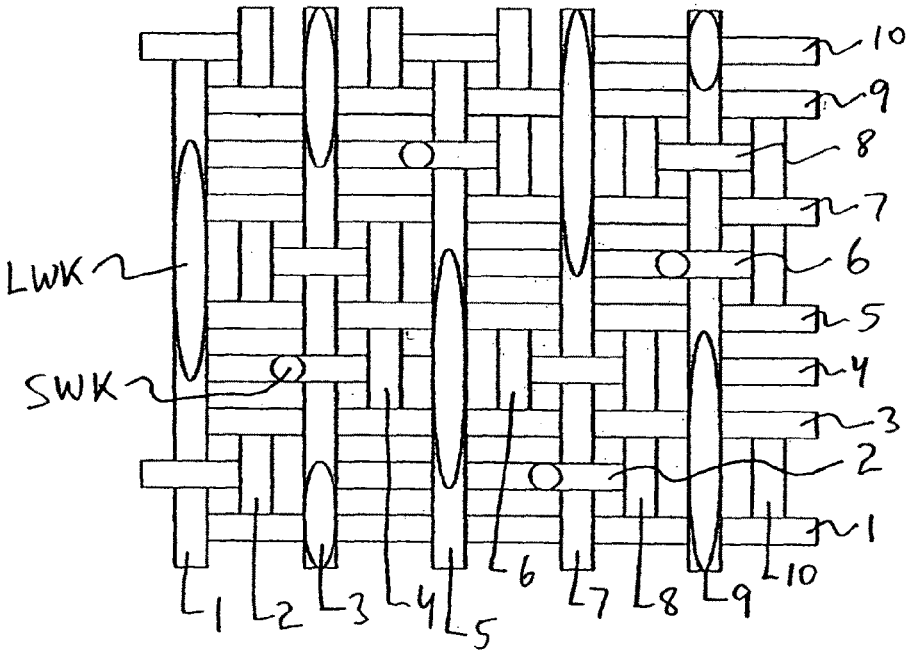
Fig. 14
| | | | | | | | | | | |
|---|---|---|---|---|---|---|---|---|---|---|
| | X | X | X | | X | X | | X | | 10 |
| X | | X | | X | | X | | X | | 9 |
| X | | X | | | X | X | X | | X | 8 |
| X | | X | | X | | X | | X | | 7 |
| X | X | | X | X | | X | | | X | 6 |
| X | | X | | X | | X | | X | | 5 |
| X | | | X | X | X | | X | X | | 4 |
| X | | X | | X | | X | | X | | 3 |
| | X | X | | X | | | X | X | X | 2 |
| X | | X | | X | | X | | X | | 1 |
| 1 | 2 | 3 | 4 | 5 | 6 | 7 | 8 | 9 | 10 | |
Fig. 15
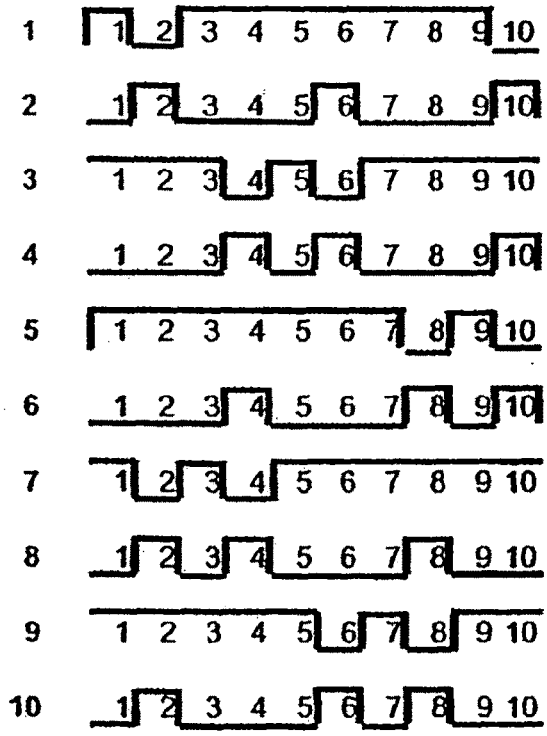

STRUCTURED FORMING FABRIC AND METHOD

BACKGROUND OF THE INVENTION

1. Field of the Invention

The present invention relates generally to papermaking, and relates more specifically to a structured forming fabrics employed in papermaking. The invention also relates to a structured forming fabric having deep pockets.

2. Discussion of Background Information

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

In a conventional tissue forming machine, the sheet is formed flat. At the press section, 100% of the sheet is pressed and compacted to reach the necessary dryness and the sheet is further dried on a Yankee and hood section. This, however, destroys the sheet quality. The sheet is then creped and wound-up, thereby producing a flat sheet.

In an ATMOS system, a sheet is formed on a structured or molding fabric and the sheet is further sandwiched between the structured or molding fabric and a dewatering fabric. The sheet is dewatered through the dewatering fabric and opposite the molding fabric. The dewatering takes place with air flow and mechanical pressure. The mechanical pressure is created by a permeable belt and the direction of air flow is from the permeable belt to the dewatering fabric. This can occur when the sandwich passes through an extended pressure nip formed by a vacuum roll and the permeable belt. The sheet is then transferred to a Yankee by a press nip. Only about 25% of the sheet is slightly pressed by the Yankee while approximately 75% of the sheet remains unpressed for quality. The sheet is dried on a Yankee/Hood dryer arrangement and then dry creped. In the ATMOS system, one and the same structured fabric is used to carry the sheet from the headbox to the Yankee dryer. Using the ATMOS system, the sheet reaches between about 35 to about 38% dryness after the ATMOS roll, which is almost the same dryness as a conventional press section. However, this advantageously occurs with almost 40 times lower nip pressure and without compacting and destroying sheet quality. Furthermore, a big advantage of the ATMOS system is that it utilizes a permeable belt which is highly tensioned, e.g., about 60 kN/m. This belt enhances the contact points and intimacy for maximum vacuum dewatering. Additionally, the belt nip is more than 20 times longer than a conventional press and utilizes air flow through the nip, which is not the case on a conventional press system.

Actual results from trials using an ATMOS system have found that the caliper and bulk of the sheet is 30% higher than the conventional through air drying (TAD) formed towel fabrics. Absorbency capacity is also 30% higher than with conventional TAD formed towel fabrics. The results were the same whether one uses 100% virgin pulp up to 100% recycled pulp. Sheets can be produced with basis weight ratios of between 14 to 40 g/m$^2$. The ATMOS system also provides excellent sheet transfer to the Yankee working at 33 to 37% dryness. There is essentially no dryness loss with the ATMOS system since the fabric has square valleys and not square knuckles (peaks). As such, these is no loss of intimacy between the dewatering fabric, the sheet, the molding fabric, and the belt. A key aspect of the ATMOS system is that it forms the sheet on the molding fabric and the same molding fabric carries the sheet from the headbox to the Yankee dryer. This produces a sheet with a uniform and defined pore size for maximum absorbency capacity.

U.S. patent application Ser. No. 11/753,435 filed on May 24, 2007, the disclosure of which is hereby expressly incorporated by reference in its entirety, discloses a structured forming fabric for an ATMOS system. The fabric utilizes an at least three float warp and weft structure which, like the prior art fabrics, is symmetrical in form.

U.S. Pat. No. 5,429,686 to CHIU et al., the disclosure of which is hereby expressly incorporated by reference in its entirety, discloses structured forming fabrics which utilize a load-bearing layer and a sculptured layer. The fabrics utilize impression knuckles to imprint the sheet and increase its surface contour. This document, however, does not teach to create pillows in the sheet for effective dewatering of TAD applications. Nor does it teach using the disclosed fabrics on an ATMOS system and/or forming the pillows in the sheet while the sheet is relatively wet and utilizing a hi-tension press nip.

U.S. Pat. No. 6,237,644 to HAY et al., the disclosure of which is hereby expressly incorporated by reference in its entirety, discloses structured forming fabrics which utilize a lattice weave pattern of at least three yarns oriented in both warp and weft directions. The fabric essentially produces shallow craters in distinct patterns. This document, however, does not teach to create deep pockets which have a three-dimensional pattern, nor does it teach using the disclosed fabrics on an ATMOS system and/or forming the pillows in the sheet while the sheet is relatively wet and utilizing a hi-tension press nip.

International Publication No. WO 2005/035867 to LAFOND et al., the disclosure of which is hereby expressly incorporated by reference in its entirety, discloses structured forming fabrics which utilize at least two different diameter yarns to impart bulk into a tissue sheet. This document, however, does not teach to create deep pockets which have a three-dimensional pattern, nor does it teach using the disclosed fabrics on an ATMOS system and/or forming the pillows in the sheet while the sheet is relatively wet and utilizing a hi-tension press nip.

U.S. Pat. No. 6,592,714 to LAMB, the disclosure of which is hereby expressly incorporated by reference in its entirety, discloses structured forming fabrics which utilize deep pockets and a measurement system. However, it is not apparent that the disclosed measurement system is replicatable. Furthermore, LAMB relies on the aspect ratio of the weave design to achieve the deep pockets. This document also does not teach using the disclosed fabrics on an ATMOS system and/or forming the pillows in the sheet while the sheet relatively wet and utilizing a hi-tension press nip.

U.S. Pat. No. 6,649,026 to LAMB, the disclosure of which is hereby expressly incorporated by reference in its entirety, discloses structured forming fabrics which utilize pockets based on five-shaft designs and with a float of three yarns in both warp and weft (or variations thereof. The fabric is then sanded. However, LAMB does not teach an extended and/or asymmetrical weave pattern having a ratio of greater than 1:1. This document also does not teach using the disclosed fabrics on an ATMOS system and/or forming the pillows in the sheet while the sheet is relatively wet and utilizing a hi-tension press nip.

International Publication No. WO 2006/113818 to KROLL et al., the disclosure of which is hereby expressly incorporated by reference in its entirety, discloses structured forming fabrics which utilize a series of two alternating deep pockets for applications in TAD. This document discloses using a ratio of greater than 1:1 for the warp to weft yarn floats on the top plane. However, KROLL does not teach to utilize one consistent sized pocket in order to provide effective and consistent dewatering and would not produce a regular sheet finish on the finished product. The fabric of KROLL also has fewer deep pockets in any given area compared to the invention. Staggering or overlapping of the warp yarns according to the invention are not disclosed. This document also does not teach using the disclosed fabrics on an ATMOS system and/or forming the pillows in the sheet while the sheet is relatively wet and utilizing a hi-tension press nip.

International Publication No. WO2005/075737 to HERMAN et al. and U.S. patent application Ser. No. 11/380,826 filed on Apr. 28, 2006, the disclosure of which are hereby expressly incorporated by reference in their entireties, disclose structured molding fabrics for an ATMOS system which can create a more three-dimensionally oriented sheet. These documents, however, do not teach, among other things, the deep pock weaves according to the invention.

International Publication No. WO 2005/075732 to SCHERB et al., the disclosure of which is hereby expressly incorporated by reference in its entirety, discloses a belt press utilizing a permeable belt in a paper machine which manufactures tissue or toweling. According to this document, the web is dried in a more efficient manner than has been the case in prior art machines such as TAD machines. The formed web is passed through similarly open fabrics and hot air is blown from one side of the sheet through the web to the other side of the sheet. A dewatering fabric is also utilized. Such an arrangement places great demands on the forming fabric because the pressure applied belt press and hot air is blown through the web in the belt press. However, this document does not teach, among other things, the deep pock weaves according to the invention.

The above-noted conventional fabrics limit the amount of bulk that can be built into the sheet being formed due to the fact that they have shallow depth pockets compared to the instant invention. Furthermore, the pockets of the conventional fabrics are merely extensions of the contact areas on the warp and weft yarns.

SUMMARY OF THE INVENTION

According to one non-limiting aspect of the invention, there is provided a structured fabric having a warp and weft structure that is asymmetrical in form. By breaking up the pattern, the invention provides offset pillows and creates a shape that is to some extent diagonal. This can improve the performance of the system in terms of on-machine drying efficiency.

According to another non-limiting aspect of the invention, there is provided a structured fabric that provides increased caliper, bulk, and absorbency in tissue and toweling.

According to another non-limiting aspect of the invention, there is provided various weave designs/configurations wherein warp impressions are utilized to provide deep pockets at optimum frequency compared to conventional fabrics. Optimum frequency will depend on what is best for the product being made. The frequency can be adjusted by varying the mesh and count of the fabric. The pockets are deeper than those of conventional fabrics because the have bottoms which are arranged on a plane lower than the contact level which borders the pocket on two sides. The floors or bottoms of the pockets can also be formed by a plain weave.

According to another non-limiting aspect of the invention, the weave designs/configurations of the invention can be used on conventional TAD systems, on an ATMOS system, on an E-TAD (i.e., a proprietary process of Georgia-Pacific) system, and/or on Metso systems.

According to another non-limiting aspect of the invention, the forming fabric of the invention is used on an ATMOS system. By dewatering from the belt press belt of the ATMOS system towards the web, structured fabric and the dewatering belt, contact area at the Yankee is enhanced and a higher dryer efficiency results at the Yankee. This is because the surface of the web which contacts the dewatering belt is the same surface which contacts the Yankee. Using such a configuration results in, among other things, a higher contact area between the paper web and the Yankee cylinder than is normally not achieved using a through air drying (TAD) system.

According to another non-limiting aspect of the invention, the weave designs/configurations of the invention can utilize shaped yarns, as well as a wide range of meshes, counts, permeabilities, yarn diameters and number of pockets per square inch as will be specified herein.

According to another non-limiting aspect of the invention, there is provided a forming fabric for the manufacture of bulky tissue and/or toweling wherein the fabric comprises a plurality of substantially equally sized pockets formed by a warp and weft interchange such that, in the upper plane of the fabric, the pockets are surrounded by warp and weft yarns, and the ratio of the length of the warp floats to the length of the weft floats is greater than about 1:1, and is most preferably, greater than about 2:1.

According to another non-limiting aspect of the invention, there is provided a forming fabric for the manufacture of bulky tissue and/or toweling wherein the fabric comprises a plurality of substantially equally sized pockets formed by having a minimum of two planes of warp and weft interchange such that in the upper plane of the fabric, the pockets are surrounded by warp and weft yarns, and the ratio of the length of the warp floats to the length of the weft floats is greater than about 1:1, and is most preferably, greater than about 2:1.

According to another non-limiting aspect of the invention, there is provided a forming fabric for the manufacture of bulky tissue and/or toweling wherein the fabric produces a tissue or towel sheet with an improved elongated surface shape for the pillows on the sheet, while also maintaining a standard pocket size thereby providing improved machine performance.

According to another non-limiting aspect of the invention, there is provided a forming fabric for the manufacture of bulky tissue and/or toweling wherein the fabric has deep pockets with ratios of warp top weft floats that are greater than about 1:1. According to one non-limiting embodiment, the fabric has a ratio of warp to weft floats of about 5:1. According to another non-limiting embodiment, the fabric has a ratio of warp to weft floats of about 7:2.

According to another non-limiting embodiment, the fabric utilizes overlapping warps and/or overlapping and staggered warps.

The invention also provides for a twin wire ATMOS system which utilizes the belt press belt disclosed in U.S. patent application Ser. No. 11/276,789 filed on Mar. 14, 2006 The disclosure of this US patent application is hereby expressly incorporated by reference in its entirety.

The invention additionally also provides for a twin wire ATMOS system which utilizes the dewatering fabric disclosed in U.S. patent application Ser. No. 11/380,835 filed Apr. 28, 2006 . The disclosure of this US patent application is hereby expressly incorporated by reference in its entirety.

The invention also provides for a dewatering system for dewatering a web wherein the system includes a twin wire former, a belt press, and a structured fabric comprising a paper web facing side and being guided over a support surface and through the belt press. The structured fabric runs at a slower speed than a wire of the twin wire former.

The structured fabric may have a permeability value of between approximately 100 cfm and approximately 1200 cfm, a paper surface contact area of between approximately 5% and approximately 70% when not under pressure and tension, and an open area of between approximately 10% and approximately 90%.

The structured fabric may comprise one of a single material, a monofilament material, a multifilament material, and two or more different materials.

The structured fabric may be resistant to at least one of hydrolysis and temperatures which exceed 100 degrees C.

The structured fabric may be an endless belt that is at least one of pre-seamed and has its ends joined on a machine which utilizes the belt press.

The web may be at least one of a tissue web, a hygiene web, and a towel web.

The invention also provides for a method of subjecting a fibrous web to pressing in a paper machine using any of the systems described herein, wherein the method comprises forming the fibrous web in the twin wire former and applying pressure to the structured fabric and the fibrous web in the belt press while the web is arranged on the structured forming fabric.

According to another non-limiting aspect of the invention, there is provided a forming fabric for making a bulky web, wherein the fabric comprises a machine facing side and a web facing side comprising pockets formed by warp and weft yarns. A bottom of the pockets is formed by an exchange of the warp and weft yarns and a contact plane of the web facing side comprises elongated warp knuckles.

The bulky web may comprise at least one of a tissue web, a hygiene web, and a towel web. The pockets may be substantially equally sized pockets. The bottom of the pockets can be formed by a plain weave of the warp and weft yarns. The elongated warp knuckles may define the upper plane of the pockets. The elongated warp knuckles may define a shape of the pockets and the shape can be substantially diamond shaped. The elongated warp knuckles may define a shape of the pockets and the shape may be at least one of non square-shaped, defined by overlapping knuckles, and defined by overlapping and staggered knuckles. A ratio of a length of warp floats to a length of weft floats can be greater than 1:1. A ratio of a length of warp floats to a length of weft floats may be greater than 2:1. A ratio of a length of warp floats to a length of weft floats may be 5:1. A ratio of a length of warp floats to a length of weft floats may be 7:2.

The fabric may comprise a warp mesh of about 61, a weft count of about 49, a permeability of approximately 545 cfm, a caliper of approximately 0.0374 inches, and a warp modulus of about 5257 kg. The fabric may also comprise a warp mesh of about 58, a weft count of about 50, a permeability of approximately 717 cfm, a caliper of approximately 0.0381 inches, and a warp modulus of about 4456 kg. The fabric may comprises one of a single material, a monofilament material, a multifilament material, and two or more different materials. The fabric may be resistant to at least one of hydrolysis and temperatures which exceed 100 degrees C. The fabric may be an endless belt that is at least one of pre-seamed and has its ends joined on a machine which utilizes the belt press. The fabric may be structured and arranged to impart a topographical pattern to a web.

The fabric may utilize a pattern repeat of four warp yarns and eight weft yarns. One of the warp yarns of the pattern repeat may float over five weft yarns. One of the warp yarns of the pattern repeat may float over weft yarns 1-5 and another of the warp yarns may float over weft yarns 5-8.

The fabric may utilize a pattern repeat of four warp yarns and ten weft yarns. One of the warp yarns of the pattern repeat may float over seven weft yarns. One of the warp yarns of the pattern repeat may float over weft yarns 4-10 and another of the warp yarns may float over weft yarns 1-5.

The fabric may utilize a pattern repeat of ten warp yarns and ten weft yarns. One of the warp yarns of the pattern repeat may float over seven weft yarns. One of the warp yarns of the pattern repeat may float over weft yarns 3-9 and another of the warp yarns may float over weft yarns 1-7.

The invention also provides for a method of subjecting a web to pressing in a paper machine using the fabric described above, wherein the method comprises forming a web and applying pressure to the fabric and the web.

The paper machine may comprise one of a TAD system, an ATMOS system, an E-TAD system, and a Metso system.

The invention also provides for a forming fabric for making a bulky web, wherein the fabric comprises a web facing side comprising pockets formed by warp and weft yarns. A bottom of the pockets is formed by a plain weave of the warp and weft yarns. A contact plane of the web facing side comprises elongated warp knuckles. A ratio of a length of warp floats to a length of weft floats is greater than 1:1

A ratio of a length of warp floats to a length of weft floats may be greater than 2:1.

The invention also provides for a forming fabric for making a bulky web, wherein the fabric comprises a web facing side comprising pockets formed by warp and weft yarns. A bottom of the pockets is formed by a plain weave of the warp and weft yarns. A contact plane of the web facing side comprises only elongated warp knuckles and/or no weft knuckles and/or elongated weft knuckles. A ratio of a length of warp floats to a length of weft floats may be greater than 1:1.

A ratio of a length of warp floats to a length of weft floats may be greater than 2:1. A ratio of a length of warp floats to a length of weft floats may be 5:1. A ratio of a length of warp floats to a length of weft floats may be 7:2.

The invention also provides for a forming fabric for making a bulky web, wherein the fabric comprises a web facing side comprising pockets formed by warp and weft yarns. A bottom of the pockets is formed by a plain weave of the warp and weft yarns and a contact plane of the web facing side comprises elongated warp knuckles. A ratio of a length of warp floats to a length of weft floats is greater than 1:1.

A ratio of a length of warp floats to a length of weft floats may be greater than 2:1. A ratio of a length of warp floats to a length of weft floats may be 5:1. A ratio of a length of warp floats to a length of weft floats may be 7:2.

The invention also provides for a paper making machine fabric comprising a woven fabric having a weave pattern which is regularly repeated over a surface. Weft yarns, warp yarns, and recesses or pockets open upwardly to a paper supporting side of the fabric. Zones are spaced over the surface of the fabric. One of the warp yarns overlays at least five of the weft yarns in direct sequence. Said one warp yarn has an adjacent warp yarn disposed on each side of said one warp yarn. A first of said at least five weft yarns extends under said one warp yarn and over the adjacent warp yarns, a second of said five weft yarns extends under the adjacent warp yarns, a third of said five weft yarns extends over the adjacent warp yarns, a fourth of said five weft yarns extends under the adjacent warp yarns, and a fifth of said five weft yarns extends over the adjacent warp yarns.

The invention also provides for a paper making machine fabric comprising a woven fabric having a weave pattern which is regularly repeated over a surface. Weft yarns, warp yarns, and recesses or pockets open upwardly to a paper supporting side of the fabric. Zones are spaced over the surface of the fabric. One of the warp yarns overlays at least seven of the weft yarns in direct sequence. Said one warp yarn has an adjacent warp yarn disposed on each side of said one warp yarn. At least three of said at least seven weft yarns extends under said one warp yarn and over the adjacent warp yarns.

The invention also provides for a paper making machine fabric comprising a woven fabric having a weave pattern which is regularly repeated over a surface. Weft yarns, warp yarns, and recesses or pockets open upwardly to a paper supporting side of the fabric. Zones are spaced over the surface of the fabric. One of the warp yarns overlays at least seven of the weft yarns in direct sequence. Said one warp yarn has an adjacent warp yarn disposed on each side of said one warp yarn. At least five of said at least seven weft yarns extends under said one warp yarn and over the adjacent warp yarns.

The invention also provides for a paper making machine fabric comprising a woven fabric having a weave pattern repeating over a surface. A pattern square for the repeating pattern contains four warp yarns and eight weft yarns. Warp yarn 1 extends over weft yarns 1-5, under weft yarn 6, over weft yarn 7 and under weft yarn 8. Warp yarn 2 extends under weft yarn 1, over weft yarn 2, under weft yarn 3, over weft yarn 4, under weft yarn 5, over weft yarn 6, under weft yarn 7 and over weft yarn 8. Warp yarn 3 extends over weft yarn 1, under weft yarn 2, over weft yarn 3, under weft yarn 4, and over weft yarns 5-8. Warp yarn 4 extends under weft yarn 1, over weft yarn 2, under weft yarn 3, over weft yarn 4, under weft yarn 5, over weft yarn 6, under weft yarn 7 and over weft yarn 8.

The invention also provides for a paper making machine fabric comprising a woven fabric having a weave pattern repeating over a surface. A pattern square for the repeating pattern contains four warp yarns and ten weft yarns. Warp yarn 1 extends under weft yarn 1, over weft yarn 2, under weft yarn 3 and over weft yarns 4-10. Warp yarn 2 extends over weft yarn 1, under weft yarns 2-3, over weft yarn 4, under weft yarn 5, over weft yarn 6, under weft yarn 7 and over weft yarn 8. Warp yarn 3 extends over weft yarns 1-5, under weft yarn 6, over weft yarn 7, under weft yarn 8 and over weft yarns 9-10. Warp yarn 4 extends over weft yarn 1, under weft yarn 2, over weft yarn 3, under weft yarns 4-5, over weft yarn 6, under weft yarns 7-8, over weft yarn 9 and under weft yarn 10.

The invention also provides for a paper making machine fabric comprising a woven fabric having a weave pattern repeating over a surface. A pattern square for the repeating pattern contains ten warp yarns and ten weft yarns. Warp yarn 1 extends over weft yarn 1, under weft yarn 2, over weft yarns 3-9 and under weft yarn 10. Warp yarn 2 extends under weft yarn 1, over weft yarn 2, under weft yarns 3-5, over weft yarn 6, under weft yarns 7-9 and over weft yarn 10. Warp yarn 3 extends over weft yarns 1-3, under weft yarn 4, over weft yarn 5, under weft yarn 6 and over weft yarns 7-10. Warp yarn 4 extends under weft yarns 1-3, over weft yarn 4, under weft yarn 5, over weft yarn 6, under weft yarns 7-9 and over weft yarn 10. Warp yarn 5 extends over weft yarns 1-7, under weft yarn 8, over weft yarn 9 and under weft yarn 10. Warp yarn 6 extends under weft yarns 1-3, over weft yarn 4, under weft yarns 5-7, over weft yarn 8, under weft yarn 9 and over weft yarn 10. Warp yarn 7 extends over weft yarn 1, under weft yarn 2, over weft yarn 3, under weft yarn 4 and over weft yarns 5-10. Warp yarn 8 extends under weft yarn 1, over weft yarn 2, under weft yarn 3, over weft yarn 4, under weft yarns 5-7, over weft yarn 8 and under weft yarns 9-10. Warp yarn 9 extends over weft yarns 1-5, under weft yarn 6, over weft yarn 7, under weft yarn 8 and over weft yarns 9-10. Warp yarn 10 extends under weft yarn 1, over weft yarn 2, under weft yarns 3-5, over weft yarn 6, under weft yarn 7, over weft yarn 8 and under weft yarns 9-10.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

FIG. 1 shows a weave pattern of a top side or paper facing side of a first non-limiting embodiment of a forming fabric according to the invention;

FIG. 2 shows a weave pattern repeat of the forming fabric shown in FIG. 1. The pattern repeat includes four warp threads and eight weft threads. The value "X" indicates locations wherein the warp threads pass over weft threads;

FIG. 3 shows cross-sections of the weave pattern repeat of the forming fabric shown in FIGS. 1 and 2, and illustrates how each of the four warp yarns weaves with the eight weft yarns;

FIG. 7 shows a weave pattern of a top side or paper facing side of a second non-limiting embodiment of a forming fabric according to the invention;

FIG. 8 shows a weave pattern repeat of the forming fabric shown in FIG. 7. The pattern repeat includes four warp threads and ten weft threads. The value "X" indicates locations wherein the warp threads pass over weft threads;

FIG. 9 shows cross-sections of the weave pattern repeat of the forming fabric shown in FIGS. 7 and 8, and illustrates how each of the four warp yarns weaves with the ten weft yarns;

FIG. 13 shows a weave pattern of a top side or paper facing side of a third non-limiting embodiment of a forming fabric according to the invention;

FIG. 14 shows a weave pattern repeat of the forming fabric shown in FIG. 13. The pattern repeat includes ten warp threads and ten weft threads. The value "X" indicates locations wherein the warp threads pass over weft threads;

FIG. 15 shows cross-sections of the weave pattern repeat of the forming fabric shown in FIGS. 13 and 14, and illustrates how each of the ten warp yarns weaves with the ten weft yarns;

DETAILED DESCRIPTION OF THE INVENTION

Figure 4:
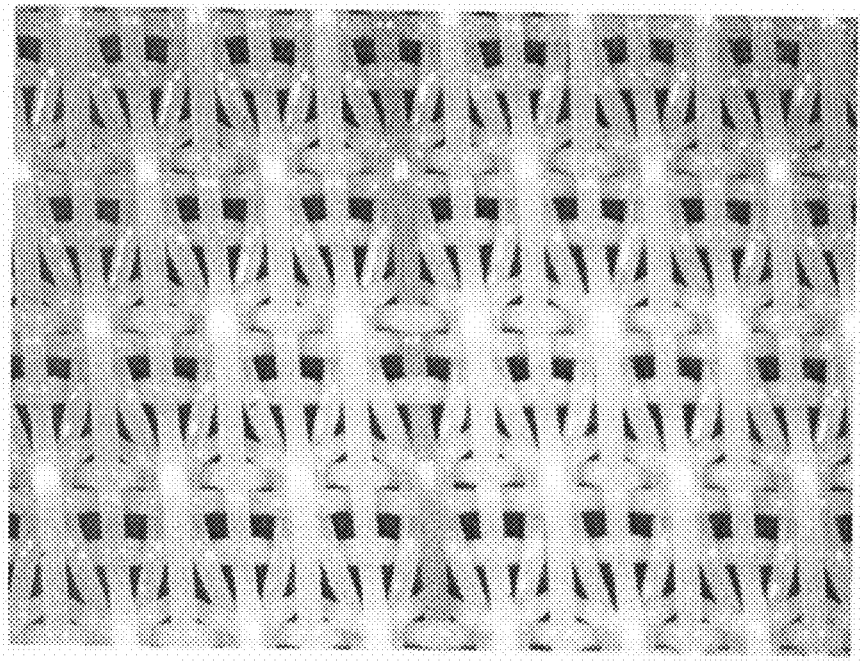
FIG. 4 shows a photograph of a top side or paper facing side of an actual forming fabric utilizing the weave pattern shown in FIG. 1.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The present invention relates to a forming fabric for a paper machine, a former for manufacturing premium tissue and toweling, and also to a former which utilizes the forming fabric and a belt press in a paper machine. The present invention relates to a twin wire former for manufacturing premium issue and toweling which utilizes the forming fabric and a belt press in a paper machine. The system of the invention is capable of producing premium tissue or toweling with a quality similar to a through-air drying (TAD) but with up to a 40% cost savings.

The present invention also relates to a twin wire former ATMOS system which utilizes a structured fabric which has good resistance to pressure and excessive tensile strain forces, and which can withstand wear/hydrolysis effects that are experienced in an ATMOS system. The system also includes a permeable belt for use in a high tension extended nip around a rotating roll or a stationary shoe and/or which is used in a papermaking device/process, and a dewatering fabric for the manufacture of premium tissue or towel grades without utilizing a through-air drying (TAD) system. The fabric has key parameters which include permeability, weight, caliper, and certain compressibility.

A first non-limiting embodiment of the structured fabric of the present invention is illustrated in FIGS. 1-6. FIG. 1 depicts a top pattern view of the top fabric plane or paper side surface of the fabric (i.e., a view of the papermaking surface). The numbers 1-4 shown on the bottom of the pattern identify the warp (machine direction) yarns while the right side numbers 1-8 show the weft (cross-direction) yarns. In FIG. 2, symbol X illustrates locations where warp yarns pass over the weft yarns and empty boxes illustrate locations where warp yarns pass under weft yarns. The shaded area formed between warp yarn 1 and warp yarn 1 of an adjacent repeat, and between weft yarn 1 and weft yarn 5, illustrates a bottom of a pocket area which will form a pillow in a web or sheet. The upper layer of the fabric defines a pocket shape between four warp knuckles LWK which is substantially diamond-shaped and non-square, i.e., which has a shape discernable in FIG. 6.

By way of non-limiting example, the parameters of the fabric shown in FIG. 1 can have a mesh (number of warp yarns per inch) of 61 and a count (number of weft yarns per inch) of 49. The fabric can have a permeability of about 545 cfm and a caliper of about 0.0374 inches. The embodiment shown in FIG. 1 also results in deep pockets with a ratio of warp top weft floats of 5:1.

The fabric of FIG. 2 shows a single repeat of the fabric that encompasses 4 warp yarns (yarns 1-4 represented vertically in FIG. 1) and 8 weft yarns (yarns 1-8 represented horizontally in FIG. 1). The fabric can be a 20 shed dsp. FIG. 3 depicts the paths of the warp yarns 1-4 as they weave with the weft yarns 1-8. While FIGS. 2 and 3 only show a single repeat unit of the fabric, those of skill in the art will appreciate that in commercial applications the repeat unit shown in FIGS. 2 and 3 would be repeated many times, in both the warp and weft directions, to form a large fabric suitable for use on a papermaking machine.

As seen in FIG. 3, warp yarn 1 floats over weft yarns 1-5, then passes under weft yarn 6, then passes over weft yarn 7, and then passes under weft yarn 8. In the area where the warp yarn 1 weaves with the weft yarns 6-8, this forms part of the plain weave bottom for a pocket. Furthermore, the long warp knuckles LWK are formed in the areas where the warp yarn 1 passes over the five weft yarns 1-5.

Warp yarn 2 weaves with weft yarns 1-8, by first passing under weft yarn 1, then over weft yarn 2, then under weft yarn 3, then over weft yarn 4, then under weft yarn 5, then over weft yarn 6, then under weft yarn 7, then under weft yarn 8. In the area where the warp yarn 2 weaves with the weft yarns 1-8, this forms part of the plain weave bottom for a pocket.

Again with reference to FIG. 3, warp yarn 3 weaves with weft yarns 14, then floats over weft yarns 5-8. In the area where the warp yarn 3 weaves with the weft yarns 1-4, this forms part of the plain weave bottom for a pocket. Furthermore, the long warp knuckles LWK are formed in the areas where the warp yarn 3 passes over the weft yarns 5-8.

Finally, warp yarn 4 weaves with weft yarns 1-8, by first passing under weft yarn 1, then over weft yarn 2, then under weft yarn 3, then over weft yarn 4, then under weft yarn 5, then over weft yarn 6, then under weft yarn 7, then under weft yarn 8. In the area where the warp yarn 4 weaves with the weft yarns 1-8, this forms part of the plain weave bottom for a pocket.

Figure 5:
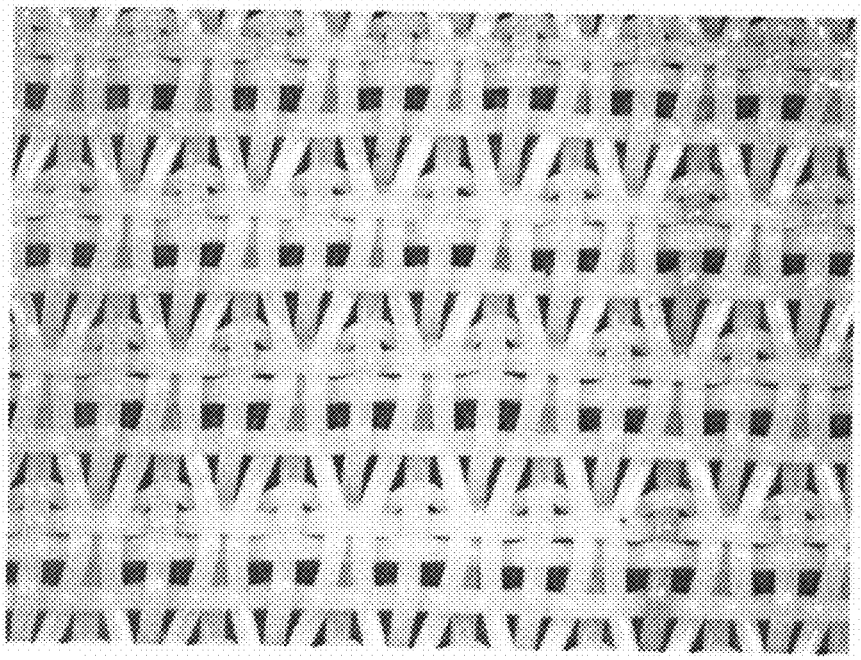
FIG. 5 shows a photograph of a bottom side or machine side of the forming fabric shown in FIG. 4.
Figure 6:
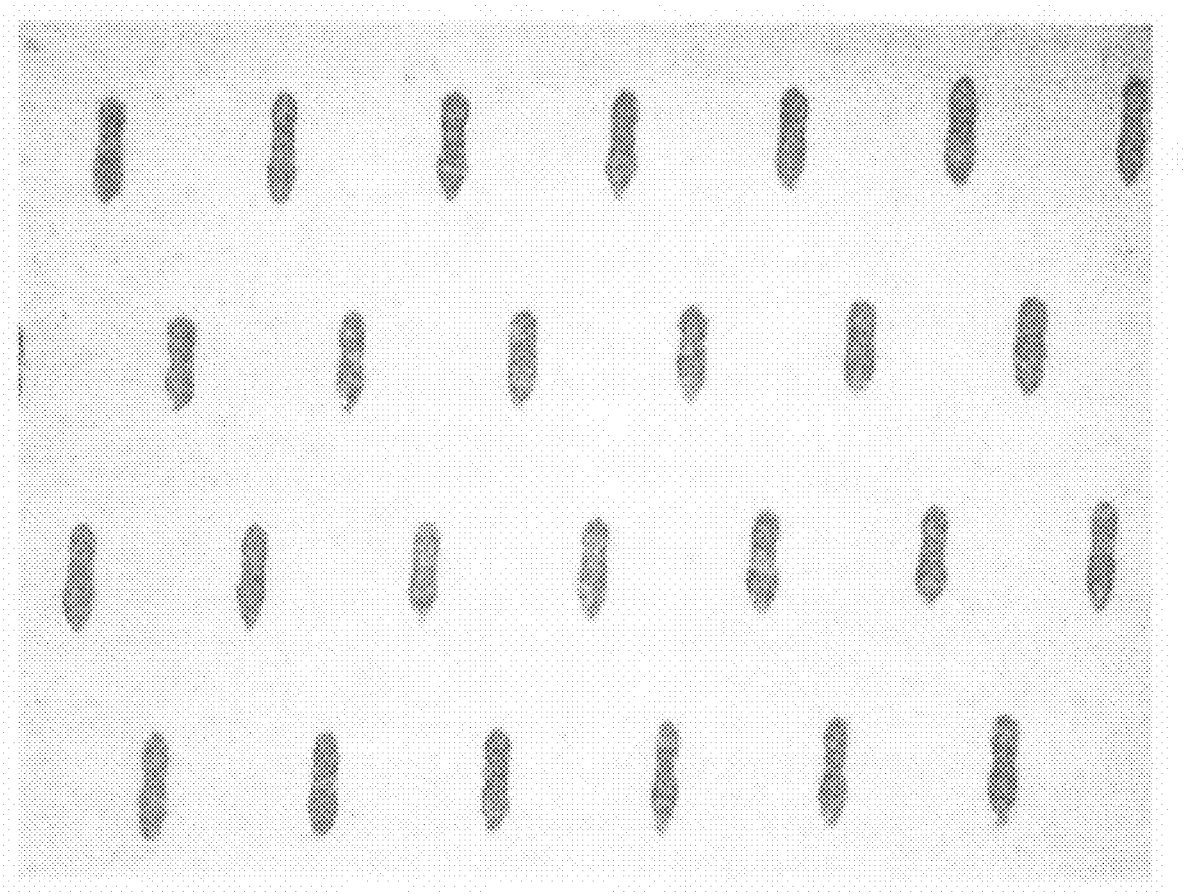
FIG. 6 shows a photograph of impressions which are formed in a sheet in contact with the top side or paper facing side of an actual forming fabric shown in FIG. 4.

FIG. 4 shows a photograph of a top side or paper facing side of an actual forming fabric utilizing the weave pattern shown in FIG. 1 and FIG. 5 shows a photograph of a bottom side or machine side of the forming fabric shown in FIG. 4;

A second non-limiting embodiment of the structured fabric of the present invention is illustrated in FIGS. 7-12. FIG. 7 depicts a top pattern view of the top fabric plane or paper side surface of the fabric (i.e., a view of the papermaking surface). The numbers 1-4 shown on the bottom of the pattern identify the warp (machine direction) yarns while the right side numbers 1-10 show the weft (cross-direction) yarns. In FIG. 8, symbol X illustrates locations where warp yarns pass over the weft yarns and empty boxes illustrate locations where warp yarns pass under weft yarns. The area formed between warp yarn 1 and warp yarn 1 of an adjacent repeat, and between weft yarn 5 and weft yarn 9, illustrates the bottom area of a pocket formed by the fabric. The upper layer of the fabric utilizes overlapping warps and defines a pocket shape between four warp knuckles LWK which is substantially an offset diamond-shaped and non-square, i.e., which has a shape discernable in FIG. 12.

By way of non-limiting example, the parameters of the fabric shown in FIG. 7 can have a mesh (number of warp yarns per inch) of 58 and a count (number of weft yarns per inch) of 50. The fabric can have a permeability of about 717 cfm and a caliper of about 0.0381 inches. The embodiment shown in FIG. 7 also results in deep pockets with a ratio of warp top weft floats of 7:2.

The fabric of FIG. 8 shows a single repeat of the fabric that encompasses 4 warp yarns (yarns 1-4 represented vertically in FIG. 7) and 10 weft yarns (yarns 1-10 represented horizontally in FIG. 7). The fabric can be a four shed dsp. FIG. 9 depicts the paths of the warp yarns 1-4 as they weave with the weft yarns 1-10. While FIGS. 8 and 9 only show a single repeat unit of the fabric, those of skill in the art will appreciate that in commercial applications the repeat unit shown in FIGS. 8 and 9 would be repeated many times, in both the warp and weft directions, to form a large fabric suitable for use on a papermaking machine.

As seen in FIG. 9, warp yarn 1 weaves with weft yarns 1-3 and then floats over weft yarns 4-10. That is, warp yarn 1 passes under weft yarn 1, then passes over weft yarn 2, then passes under weft yarn 3, and then floats over weft yarns 4-10. In the area where the warp yarn 1 weaves with the weft yarns 1-3, this forms part of the plain weave bottom for a pocket. Furthermore, the long warp knuckles LWK are formed in the areas where the warp yarn 1 passes over the seven weft yarns 4-10.

Warp yarn 2 weaves with weft yarns 1 and 4-8, by first passing over weft yarn 1, then under weft yarns 2-3, then over weft yarn 4, then under weft yarn 5, then over weft yarn 6, then under weft yarn 7, then over weft yarn 8, then under weft yarns 9-10. In the area where the warp yarn 2 weaves with the weft yarns 4-8, this forms part of the plain weave bottom for a pocket.

Again with reference to FIG. 9, warp yarn 3 floats over weft yarns 1-5, then weaves with weft yarns 6-8. Then, warp yarn 3 passes over weft yarns 9-10. In the area where the warp yarn 3 weaves with the weft yarns 6-8, this forms part of the plain weave bottom for a pocket. Furthermore, the long warp knuckles LWK are formed in the areas where the warp yarn 3 passes over the weft yarns 1-5.

Finally, warp yarn 4 weaves with weft yarns 1-3, 6 and 9, by first passing over weft yarn 1, then under weft yarn 2, then over weft yarn 3, then under weft yarns 4-5, then over weft yarn 6, then under weft yarns 7-8, then over weft yarn 9, and then under weft yarn 10. In the area where the warp yarn 4 weaves with the weft yarns 1-3, 6 and 9, this forms part of the plain weave bottom for a pocket.

Figure 10:
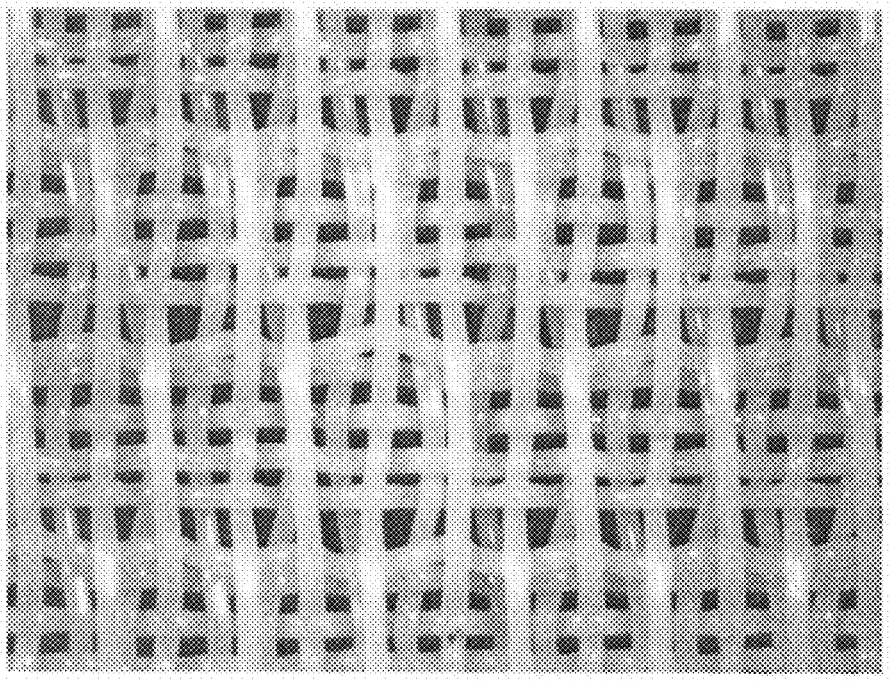
FIG. 10 shows a photograph of a top side or paper facing side of an actual forming fabric utilizing the weave pattern shown in FIG. 7.
Figure 11:
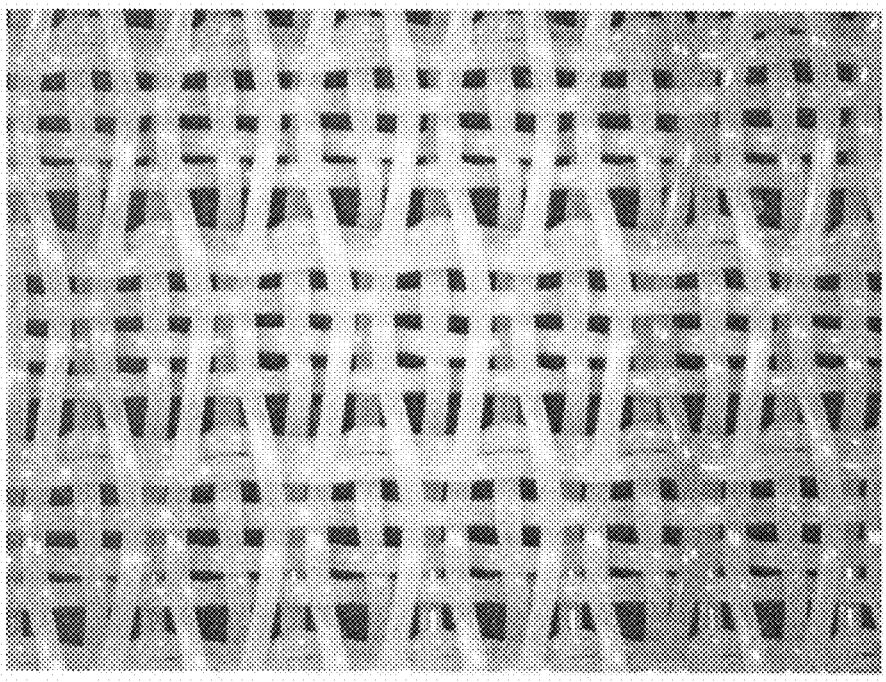
FIG. 11 shows a photograph of a bottom side or machine side of the forming fabric shown in FIG. 10.
Figure 12:
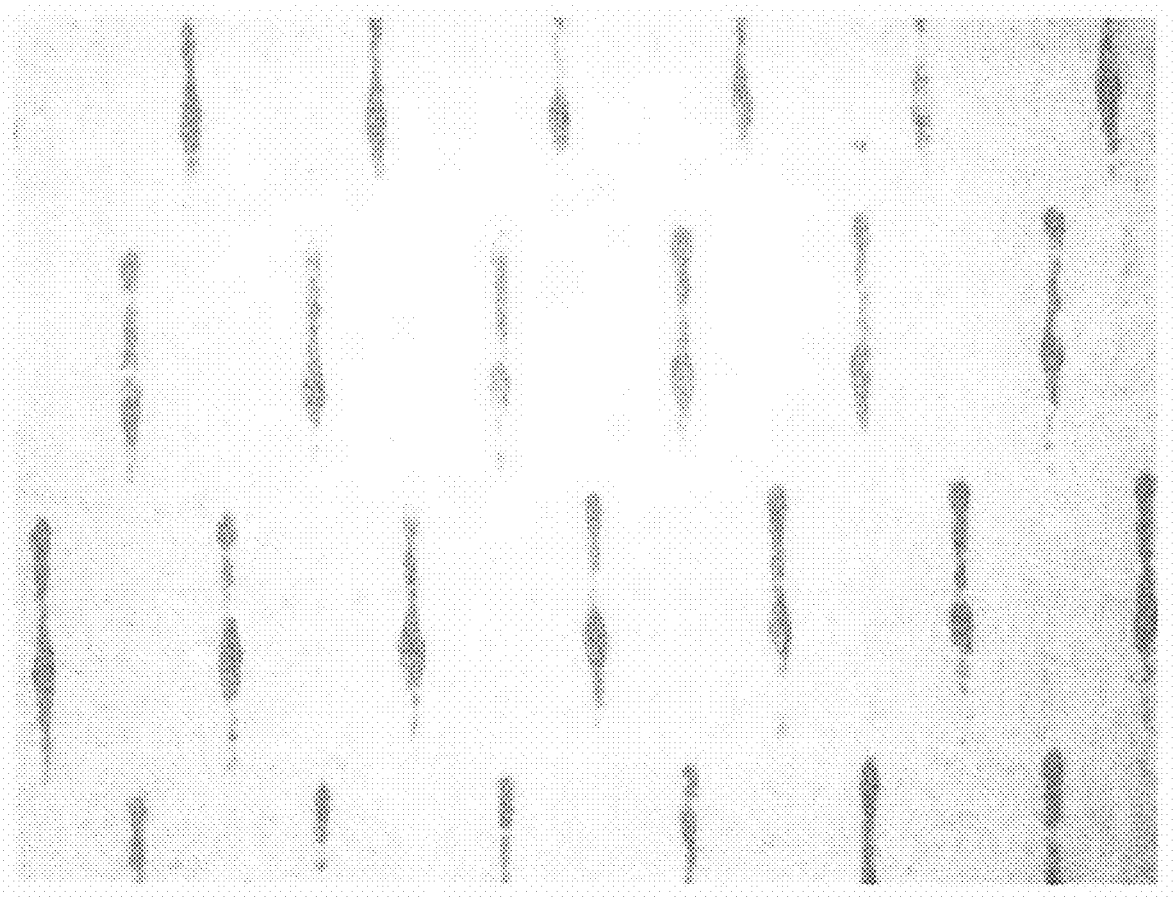
FIG. 12 shows a photograph of impressions which are formed in a sheet in contact with the top side or paper facing side of an actual forming fabric shown in FIG. 10.

FIG. 11 shows a photograph of a bottom side or machine side of the forming fabric shown in FIG. 10 and FIG. 12 shows a photograph of impressions which are formed in a sheet in contact with the top side or paper facing side of an actual forming fabric shown in FIG. 10.

A third non-limiting embodiment of the structured fabric of the present invention is illustrated in FIGS. 13-18. FIG. 13 depicts a top pattern view of the top fabric plane or paper side surface of the fabric (i.e., a view of the papermaking surface). The numbers 1-10 shown on the bottom of the pattern identify the warp (machine direction) yarns while the right side numbers 1-10 show the weft (cross-direction) yarns. In FIG. 14, symbol X illustrates locations where warp yarns pass over the weft yarns and empty boxes illustrate locations where warp yarns pass under weft yarns. The area formed between warp yarn 1 and warp yarn 5, and between weft yarn 5 and weft yarn 7, illustrates the bottom area of a pocket formed by the fabric. The upper layer of the fabric utilizes staggered overlapping warps and defines a pocket shape between long warp knuckles LWK and short weft knuckles SWK which has a shape discernable in FIG. 18.

By way of non-limiting example, the parameters of the fabric shown in FIG. 13 can have a mesh (number of warp yarns per inch) of 59 and a count (number of weft yarns per inch) of 48. The fabric can have a permeability of about 600 cfm and a caliper of about 0.042 inches. The embodiment shown in FIG. 13 also results in deep pockets with a ratio of warp top weft floats of 7:2.

The fabric of FIG. 14 shows a single repeat of the fabric that encompasses 10 warp yarns (yarns 1-10 represented vertically in FIG. 13) and 10 weft yarns (yarns 1-10 represented horizontally in FIG. 13). The fabric can be a ten shed dsp. FIG. 15 depicts the paths of the warp yarns 1-10 as they weave with the weft yarns 1-10. While FIGS. 14 and 15 only show a single repeat unit of the fabric, those of skill in the art will appreciate that in commercial applications the repeat unit shown in FIGS. 14 and 15 would be repeated many times, in both the warp and weft directions, to form a large fabric suitable for use on a papermaking machine.

As seen in FIG. 15, warp yarn 1 weaves with weft yarns 1-2, then floats over weft yarns 3-9, and weaves with weft yarn 10. That is, warp yarn 1 passes over weft yarn 1, then passes under weft yarn 2, then floats over weft yarns 3-9, and then weaves with weft yarn 10. In the area where the warp yarn 1 weaves with the weft yarns 1-3, this forms part of the plain weave bottom for a pocket. Furthermore, the long warp knuckles LWK are formed in the areas where the warp yarn 1 passes over the seven weft yarns 3-9.

Warp yarn 2 weaves with weft yarns 2, 6 and 10, and passes under weft yarns 3-5 and 7-9 by first passing under weft yarn 1, then over weft yarn 2, then passes under weft yarns 3-5, then over weft yarn 6, then passes under weft yarns 7-9, and then over weft yarn 10. In the area where the warp yarn 2 weaves with the weft yarns 1-3, this forms part of the plain weave bottom for a pocket.

Again with reference to FIG. 15, warp yarn 3 floats over weft yarns 1-3 and 7-10, and weaves with weft yarns 4-6. That is, warp yarn 3 passes over weft yarns 1-3, then passes under weft yarn 4, then over weft yarn 5, and then under weft yarn 6. Then, warp yarn 3 floats over weft yarns 7-10. In the area where the warp yarn 3 weaves with the weft yarns 5-6, this forms part of the plain weave bottom for a pocket. Furthermore, the long warp knuckles LWK are formed in the areas where the warp yarn 3 passes over, e.g., weft yarns 1-3. The short weft knuckles SWK are formed in the areas where, e.g., the warp yarn 3 passes under weft yarn 4.

Warp yarn 4 passes under weft yarns 1-3 and 7-9 and weaves with weft yarns 4-6 and 10, by first passing under weft yarns 1-3, then over weft yarn 4, then under weft yarn 5, then over weft yarn 6, then under weft yarns 7-9, and then over weft yarn 10. In the area where the warp yarn 4 weaves with the weft yarns 5-7, this forms part of the plain weave bottom for a pocket.

Again with reference to FIG. 15, warp yarn 5 weaves with weft yarns 8-10 after passing over weft yarns 1-7. That is, warp yarn 5 passes over weft yarns 1-7, then passes under weft yarn 8, then over weft yarn 9, and then passes under weft yarn 10. In the area where the warp yarn 5 weaves with the weft yarns 9-10, this forms part of the plain weave bottom for a pocket. Furthermore, the long warp knuckles LWK are formed in the areas where the warp yarn 5 passes over the seven weft yarns 1-7. The short weft knuckles SWK are formed in the areas where, e.g., the warp yarn 5 passes under weft yarn 8.

Warp yarn 6 passes under weft yarns 1-3 and 5-7 and weaves with weft yarns 4 and 8-10, by first passing under weft yarns 1-3, then over weft yarn 4, then under weft yarns 5-7, then over weft yarn 8, then under weft yarn 9, and then over weft yarn 10. In the area where the warp yarn 6 weaves with, e.g., weft yarns 3-5, this forms part of the plain weave bottom for a pocket.

Again with reference to FIG. 15, warp yarn 7 weaves with weft yarns 1-4 before passing over weft yarns 5-10. That is, warp yarn 7 passes over weft yarn 1, then passes under weft yarn 2, then over weft yarn 3, then under weft yarn 4, and then passes over weft yarns 5-10. In the area where the warp yarn 7 weaves with the weft yarns 3-5, this forms part of the plain weave bottom for a pocket. Furthermore, the long warp knuckles LWK are formed in the areas where the warp yarn 7 passes over the weft yarns 5-10. The short weft knuckles SWK are formed in the areas where, e.g., the warp yarn 7 passes under weft yarn 2.

Warp yarn 8 weaves with weft yarns 1-4 and 8, and passes under weft yarns 5-7 and 9-10 by first passing under weft yarn 1, then over weft yarn 2, then passes under weft yarn 3, then over weft yarn 4, then passes under weft yarns 5-7, then over weft yarn 8, and then under weft yarns 9-10. In the area where the warp yarn 8 weaves with, e.g., weft yarns 3-5, this forms part of the plain weave bottom for a pocket.

Again with reference to FIG. 15, warp yarn 9 floats over weft yarns 1-5 and 9-10, and weaves with weft yarns 6-8. That is, warp yarn 9 passes over weft yarns 1-5, then passes under weft yarn 6, then over weft yarn 7, then under weft yarn 8. Then, warp yarn 9 floats over weft yarns 9-10. In the area where the warp yarn 9 weaves with the weft yarns 7-8, this forms part of the plain weave bottom for a pocket. Furthermore, the long warp knuckles LWK are formed in the areas where the warp yarn 9 passes over, e.g., weft yarns 1-5. The short weft knuckles SWK are formed in the areas where, e.g., the warp yarn 9 passes under weft yarn 6.

Warp yarn 10 weaves with weft yarns 2 and 6-8, and passes under weft yarns 3-5 and 9-10 by first passing under weft yarn 1, then over weft yarn 2, then passes under weft yarns 3-5, then over weft yarn 6, then passes under weft yarn 7, then over weft yarn 8, and then under weft yarns 9-10. In the area where the warp yarn 10 weaves with, e.g., weft yarns 2-4, this forms part of the plain weave bottom for a pocket.

Figure 16:
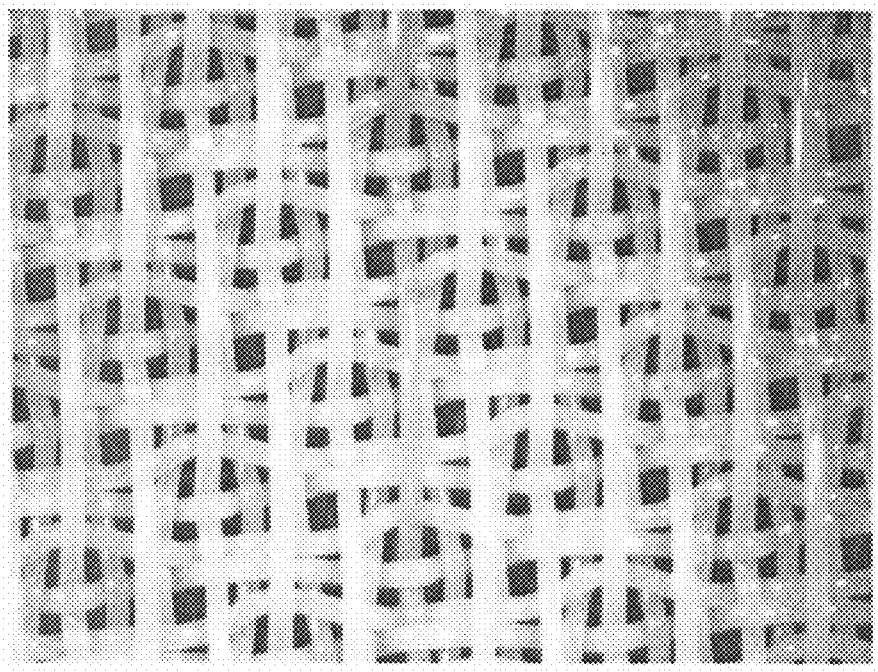
FIG. 16 shows a photograph of a top side or paper facing side of an actual forming fabric utilizing the weave pattern shown in FIG. 13.
Figure 17:
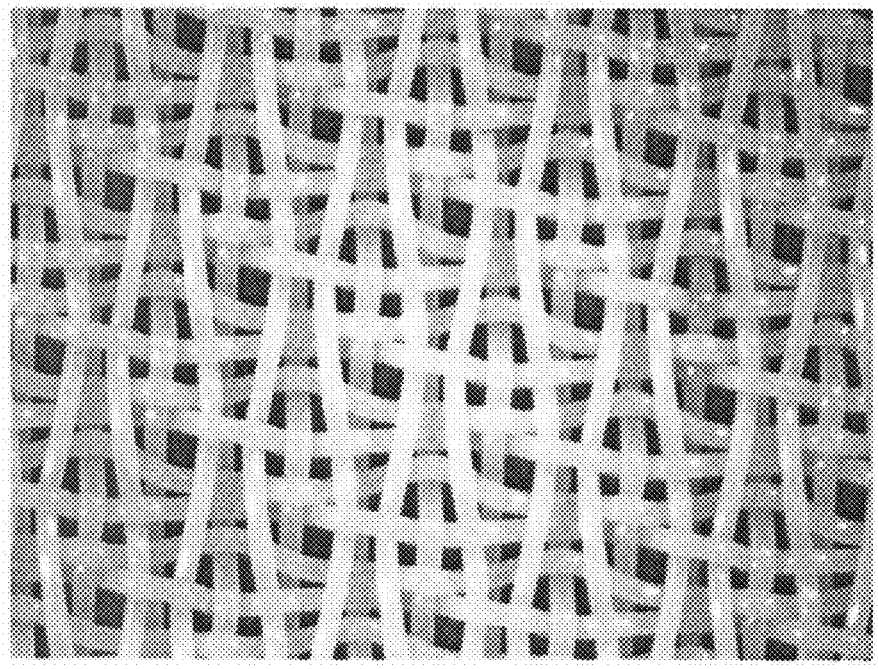
FIG. 17 shows a photograph of a bottom side or machine side of the forming fabric shown in FIG. 16.
Figure 18:
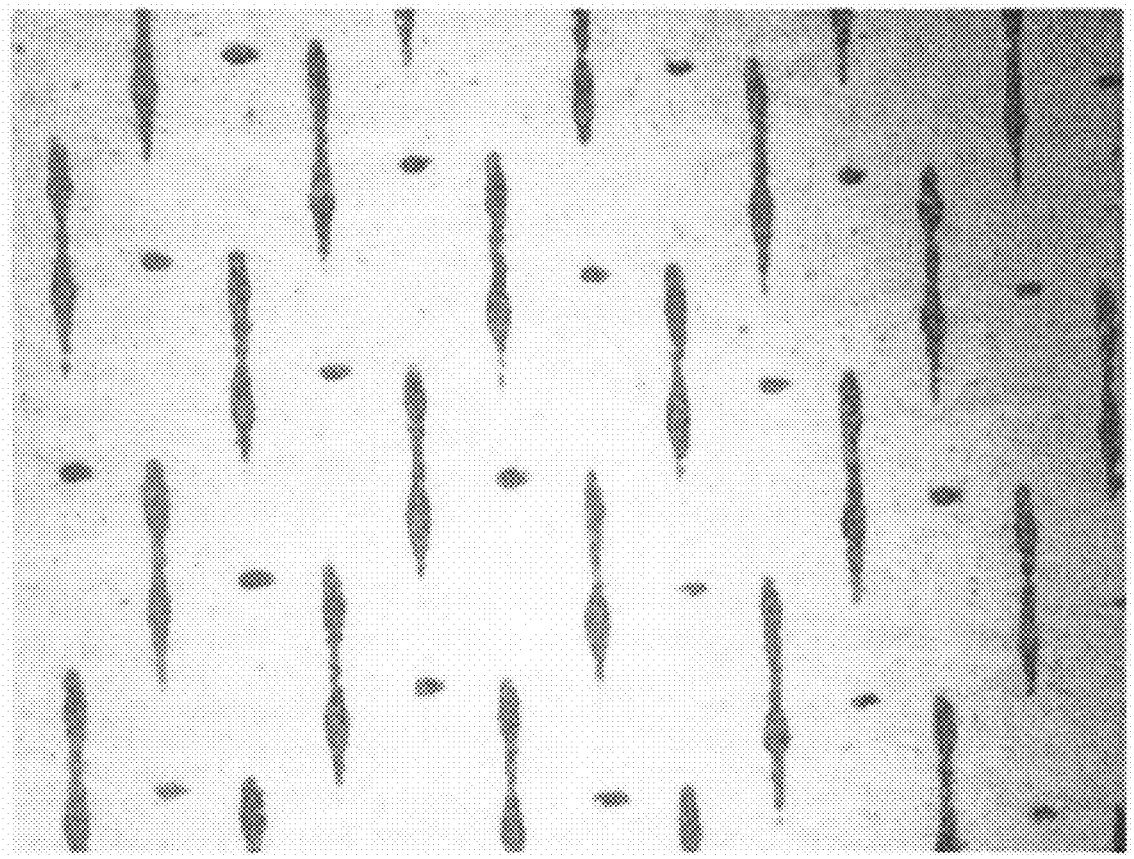
FIG. 18 shows a photograph of impressions which are formed in a sheet in contact with the top side or paper facing side of an actual forming fabric shown in FIG. 16.

FIG. 16 shows a photograph of a top side or paper facing side of an actual forming fabric utilizing the weave pattern shown in FIG. 13 and FIG. 17 shows a photograph of a bottom side or machine side of the forming fabric shown in FIG. 16.

The invention also provides for utilizing any of the herein disclosed fabrics on a machine for making a fibrous web, e.g., a tissue, hygiene paper wed, etc., which can be, e.g., a twin wire ATMOS system for processing a fibrous web. By way of non-limiting example, the ATMOS system can be of the type disclosed in U.S. patent application Ser. No. 11/735,211 filed on Apr. 13, 2007, the disclosure of which is hereby expressly incorporated by reference in its entirety.

The ATMOS system can include a headbox which feeds a suspension to a twin wire former formed by an outer wire, an inner wire and a forming roll. The twin wire former can be of any conventionally known type and can preferably be of the type disclosed in e.g., US Patent Application Publication No. 2006/0085999 (based on U.S. application Ser. No. 11/189,884 filed on Jul. 27, 2005), the disclosure of which is hereby expressly incorporated by reference in its entirety. Once the web is formed by the twin wire former, the web is conveyed by the inner wire to a structured fabric. The web is transferred to the structured fabric from the inner wire using a suction box located at a pick-up area. The web is conveyed by the structured fabric, of the type described above, to and through a pressing arrangement, e.g., formed by a belt press assembly composed of a permeable tension belt and a vacuum roll. A dewatering fabric can also pass over the vacuum roll and through the belt press assembly. The web can be dewatered in an extended belt press nip, e.g., formed by the belt press assembly and the vacuum roll and may then be carried by the structured belt to a Yankee cylinder and hood arrangement, and can then be transferred to the Yankee using a press roll. A steam box and hot air blower arrangement may be arranged within the permeable tension belt and is arranged over a suction zone of the vacuum roll. One or more savealls can be utilized to collect moisture collected from the vacuum roll. The system can also utilize a number of guide rolls for each of the belts/fabrics, an adjusting roll for the dewatering belt, a number of Uhle boxes, a number of shower units, and an additional suction box or pick-up.

The structured fabric can preferably be an endless fabric which transports the web to and from the belt press system, from the twin wire former, and to the Yankee cylinder for final drying. After being transferred from the twin wire former, the web lies in the three-dimensional structure of the fabric, and therefore it is not flat but has also a three-dimensional structure, which produces a high bulky web.

By way of non-limiting example, the structured fabric can be a single or multi-layered woven fabric which can withstand the high pressures, heat, moisture concentrations, and which can achieve a high level of water removal and also mold or emboss the paper web required by the Voith ATMOS paper making process. The fabric should also have a width stability and a suitable high permeability. The fabric should also preferably utilize hydrolysis and/or temperature resistant materials.

The fabric may also preferably be utilized as part of a sandwich structure which includes at least two other belts and/or fabrics. These additional belts include a high tension belt and a dewatering belt. The sandwich structure is subjected to pressure and tension over an extended nip formed by a rotating roll or static support surface. The extended nip can have an angle of wrap of between approximately 30 degrees and approximately 180 degrees, and is preferably between approximately 50 degrees and approximately 130 degrees. The nip length can be between approximately 800 mm and approximately 2500 mm, and is preferably between approximately 1200 mm and approximately 1500 mm. The nip can be formed by a rotating suction roll having a diameter that is between approximately 1000 mm and approximately 2500 mm, and is preferably between approximately 1400 mm and approximately 1700 mm.

As explained above, the structured fabric imparts a topographical pattern into the paper sheet or web. To accomplish this, high pressures can be imparted to the fabric via a high tension belt. The topography of the sheet pattern can be manipulated by varying the specifications of the fabric, i.e., by regulating parameters such as, yarn diameter, yarn shape, yarn density, and yarn type. Different topographical patterns can be imparted in the sheet by different surface weaves. Similarly, the intensity of the sheet pattern can be varied by altering the pressure imparted by the high tension belt and by varying the specification of the fabric. Other factors which can influence the nature and intensity of the topographical pattern of the sheet include air temperature, air speed, air pressure, belt dwell time in the extended nip, and nip length.

The following are non-limiting characteristics and/or properties of the structured fabric: to enable suitable dewatering, the single or multi-layered fabric should have a permeability value of between approximately 100 cfm and approximately 1200 cfm, and is preferably between approximately 200 cfm and approximately 900 cfm; the fabric which is part of a sandwich structure with two other belts, e.g., a high tension belt and a dewatering belt, is subjected to pressure and tension over a rotating or static support surface and at an angle of wrap of between approximately 30 degrees and approximately 180 degrees and preferably between approximately 50 degrees and approximately 130 degrees; the fabric should have a paper surface contact area of between approximately 5% and approximately 70% when not under pressure or tension; the forming fabric should have an open area of between approximately 10% and approximately 90%.

The fabric is preferably a woven fabric that can be installed on an ATMOS machine as a pre-joined and/or seamed continuous and/or endless belt. Alternatively, the forming fabric can be joined in the ATMOS machine using e.g., a pin-seam arrangement or can otherwise be seamed on the machine. In order to resist the high moisture and heat generated by the ATMOS papermaking process, the woven single or multi-layered fabric may utilize either hydrolysis and/or heat resistant materials. Hydrolysis resistant materials should preferably include a PET monofilament having an intrinsic viscosity value normally associated with dryer and TAD fabrics in the range of between 0.72 IV (Intrinsic Velocity, i.e., a dimensionless number used to correlate the molecular weight of a polymer. The higher the number the higher the molecular weight) and approximately 1.0 IV and also have a suitable "stabilization package" which including carboxyl end group equivalents, as the acid groups catalyze hydrolysis and residual DEG or di-ethylene glycol as this too can increase the rate of hydrolysis. These two factors separate the resin which can be used from the typical PET bottle resin. For hydrolysis, it has been found that the carboxyl equivalent should be as low as possible to begin with, and should be less than approximately 12. The DEG level should be less than approximately 0.75%. Even at this low level of carboxyl end groups it is essential that an end capping agent be added, and should utilize a carbodiimide during extrusion to ensure that at the end of the process there are no free carboxyl groups. There are several classes of chemical than can be used to cap the end groups such as epoxies, ortho-esters, and isocyanates, but in practice monomeric and combinations of monomeric with polymeric carbodiimindes are the best and most used.

Heat resistant materials such as PPS can be utilized in the structured fabric. Other materials such as PEN, PBT, PEEK and PA can also be used to improve properties of the fabric such as stability, cleanliness and life. Both single polymer yarns and copolymer yarns can be used. The material for the fabric need not necessarily be made from monofilament and can be a multi-filament, core and sheath, and could also be a non-plastic material, i.e., a metallic material. Similarly, the fabric may not necessarily be made of a single material and can be made of two, three or more different materials. The use of shaped yarns, i.e., non-circular yarns, can also be utilized to enhance or control the topography or properties of the paper sheet. Shaped yarns can also be utilized to improve or control fabric characteristics or properties such as stability, caliper, surface contact area, surface planarity, permeability and wearability.

The structured fabric can also be treated and/or coated with an additional polymeric material that is applied by, e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduce drive loads. The treatment/coating can be applied to impart/improve one or several of these properties of the fabric. As indicated previously, the topographical pattern in the paper web can be changed and manipulated by use of different single and multi-layer weaves. Further enhancement of the pattern can be further attained by adjustments to the specific fabric weave by changes to the yarn diameter, yarn counts, yarn types, yarn shapes, permeability, caliper and the addition of a treatment or coating etc. Finally, one or more surfaces of the fabric or molding belt can be subjected to sanding and/or abrading in order to enhance surface characteristics.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface.

In a typical embodiment of the fabrics disclosed herein, preferably the diameter of the warp and weft yarns can be between about 0.10 and 0.50 mm. The diameter of the warp yarns can be about 0.45 mm, is preferably about 0.27 mm, and is most preferably about 0.35 mm. The diameter of the weft yarns can be about 0.50 mm, is preferably about 0.35 mm, and is most preferably about 0.42 mm. Those of skill in the art will appreciate that yarns having diameters outside the above ranges may be used in certain applications. In one embodiment of the present invention, the warp and weft yarns can have diameters of between about 0.13 mm, and 0.17 mm. Fabrics employing these yarn sizes may be implemented with polyester yarns or with a combination of polyester and nylon yarns.

It is noted that the foregoing examples have been provided merely for the purpose of explanation and are in no way to be construed as limiting of the present invention. While the present invention has been described with reference to exemplary embodiments, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular arrangements, materials and embodiments, the invention is not intended to be limited to the particulars disclosed herein. Instead, the invention extends to all functionally equivalent structures, methods and uses, such as are within the scope of the appended claims.

What is claimed:

1. A forming fabric for making a bulky web, comprising:
a machine facing side;
a web facing side comprising pockets formed by warp and weft yarns;
a bottom of the pockets being formed by weaving the warp and weft yarns; and
a contact plane of the web facing side comprising elongated warp knuckles,
wherein one of:
the pockets are surrounded and defined by four elongated warp knuckles on the web facing side,
the pockets are surrounded on all sides by elongated warp knuckles on the web facing side,
the pockets have a substantially diamond shape formed by elongated warp knuckles on the web facing side,
the pockets have an offset diamond shape formed by elongated warp knuckles on the web facing side,
the pockets have a non-square shape formed by elongated warp knuckles on the web facing side,
the pockets are defined by overlapping and staggered elongated warp knuckles on the web facing side, and
the pockets have a multi-sided shape formed by plural elongated warp knuckles and two short weft knuckles on the web facing side.

2. The fabric of claim 1, wherein the bulky web comprises at least one of a tissue web, a hygiene web, and a towel web.

3. The fabric of claim 1, wherein the pockets are substantially equally sized pockets.

4. The fabric of claim 1, wherein the bottom of the pockets are formed by a plain weave of the warp and weft yarns.

5. The fabric of claim 1, wherein the elongated warp knuckles define the upper plane of the pockets.

6. The fabric of claim 1, wherein the elongated warp knuckles define the shape of the pockets and the shape is substantially diamond shaped.

7. The fabric of claim 1, wherein the elongated warp knuckles define a shape of the pockets and the shape is at least one of:
non square-shaped;
defined by overlapping elongated warp knuckles; and
defined by overlapping and staggered elongated warp knuckles.

8. The fabric of claim 1, wherein a ratio of a length of warp floats to a length of weft floats is greater than 1:1.

9. The fabric of claim 1, wherein a ratio of a length of warp floats to a length of weft floats is greater than 2:1.

10. The fabric of claim 1, wherein a ratio of a length of warp floats to a length of weft floats is 5:1.

11. The fabric of claim 1, wherein the fabric comprises at least one of:
a single material;
a monofilament material;
a multifilament material; and
two or more different materials.

12. The fabric of claim 1, wherein the fabric is resistant to at least one of hydrolysis and temperatures which exceed 100 degrees C.

13. The fabric of claim 1, wherein the fabric is an endless belt that is at least one of pre-seamed and has its ends joined on a machine which utilizes a belt press.

14. The fabric of claim 1, wherein the fabric is structured and arranged to impart a topographical pattern to a web.

15. The fabric of claim 1, wherein the fabric utilizes a pattern repeat of ten warp yarns and ten weft yarns.

16. A method of forming a web in a paper machine using the fabric of claim 1, the method comprising:
supplying a web material to the fabric; and
applying pressure to the fabric and the web material.

17. The method of claim 16, wherein the paper machine comprises one of:
a TAD system;
an ATMOS system;
an E-TAD system; and
a Metso system.

18. A forming fabric for making a bulky web, comprising:
a machine facing side;
a web facing side comprising pockets formed by warp and weft yarns;
a bottom of the pockets being formed by weaving the warp and weft yarns; and
a contact plane of the web facing side comprising elongated warp knuckles,
wherein a ratio of a length of warp floats to a length of weft floats is 7:2.

19. A forming fabric for making a bulky web, comprising:
a machine facing side;
a web facing side comprising pockets formed by warp and weft yarns;
a bottom of the pockets being formed by weaving the warp and weft yarns; and
a contact plane of the web facing side comprising elongated warp knuckles,
wherein the fabric comprises a warp mesh of about 61, a weft count of about 49, a permeability of approximately 545 cfm, a caliper of approximately 0.0374 inches, and a warp modulus of about 5257 kg.

20. A forming fabric for making a bulky web, comprising:
a machine facing side;
a web facing side comprising pockets formed by warp and weft yarns;
a bottom of the pockets being formed by weaving the warp and weft yarns; and a contact plane of the web facing side comprising elongated warp knuckles, wherein the fabric comprises a warp mesh of about 58, a weft count of about 50, a permeability of approximately 717 cfm, a caliper of approximately 0.0381 inches, and a warp modulus of about 4456 kg.

21. A forming fabric for making a bulky web, comprising:

a machine facing side;

a web facing side comprising pockets formed by warp and weft yarns;

a bottom of the pockets being formed by weaving the warp and weft yarns; and a contact plane of the web facing side comprising elongated warp knuckles, wherein the fabric utilizes a pattern repeat of four warp yarns and eight weft yarns.

22. The fabric of claim 21, wherein one of the warp yarns of the pattern repeat floats over five weft yarns.

23. The fabric of claim 21, wherein one of the warp yarns of the pattern repeat floats over weft yarns 1-5 and another of the warp yarns floats over weft yarns 5-8.

24. A forming fabric for making a bulky web, comprising:

a machine facing side;

a web facing side comprising pockets formed by warp and weft yarns;

a bottom of being weaving the warp and weft yarns: and a contact plane of the web facing side comprising elongated warp knuckles, wherein the fabric utilizes a pattern repeat of four warp yarns and ten weft yarns.

25. The fabric of claim 24, wherein one of the warp yarns of the pattern repeat floats over seven weft yarns.

26. The fabric of claim 24, wherein one of the warp yarns of the pattern repeat floats over weft yarns 4-10 and another of the warp yarns floats over weft yarns 1-5.

27. A forming fabric for making a bulky web, comprising:

a machine facing side;

a web facing side comprising pockets formed by warp and weft yarns;

a bottom of the pockets being formed by weaving the warp and weft yarns; and a contact plane of the web facing side comprising elongated warp knuckles, wherein the fabric utilizes a pattern repeat of ten warp yarns and ten weft yarns, and wherein one of the warp yarns of the pattern repeat floats over seven weft yarns.

28. A forming fabric for making a bulky web, comprising:

a machine facing side;

a web facing side comprising pockets formed by warp and weft yarns;

a bottom of the pockets being formed by weaving the warp and weft yarns; and a contact plane of the web facing side comprising elongated warp knuckles, wherein the fabric utilizes a pattern repeat of ten warp yarns and ten weft yarns, and wherein one of the warp yarns of the pattern repeat floats over weft yarns 3-9 and another of the warp yarns floats over weft yarns 1-7.

29. A forming fabric for making a bulky web, comprising:

a web facing side comprising pockets formed by warp and weft yarns;

a bottom of the pockets being formed by a plain weave of the warp and weft yarns; and a contact plane of the web facing side, wherein a ratio of a length of warp floats to a length of weft floats is greater than 1:1, and wherein one of:

the pockets are defined by four elongated warp knuckles on the web facing side, the pockets have a substantially diamond shape formed by elongated warp knuckles on the web facing side, and the pockets have an offset diamond shape formed by elongated warp knuckles on the web facing side.

30. The fabric of claim 29, wherein a ratio of a length of warp floats to a length of weft floats is greater than 2:1.

31. The fabric of claim 29, wherein a ratio of a length of warp floats to a length of weft floats is 5:1.

32. A forming fabric for making a bulky web, comprising:

a web facing side comprising pockets formed by warp and weft yarns;

a bottom of the pockets being formed by a plain weave of the warp and weft yarns; and a contact plane of the web facing side comprising elongated warp knuckles, wherein a ratio of a length of warp floats to a length of weft floats is greater than 1:1, and wherein a ratio of a length of warp floats to a length of weft floats is 7:2.

33. A forming fabric for making a bulky web, comprising:

a web facing side comprising substantially equally sized pockets formed by warp and weft yarns;

a bottom of the pockets being formed by a plain weave of the warp and weft yarns; and a contact plane of the web facing side comprising elongated warp knuckles and short weft knuckles, wherein a ratio of a length of warp floats to a length of weft floats is greater than 1:1, and wherein the pockets have a multi-sided shape formed by plural elongated warp knuckles and two short weft knuckles on the web facing side.

34. The fabric of claim 33, wherein a ratio of a length of warp floats to a length of weft floats is greater than 2:1.

35. The fabric of claim 33, wherein a ratio of a length of warp floats to a length of weft floats is 5:1.

36. A forming fabric for making a bulky web, comprising:

a web facing side comprising substantially equally sized pockets formed by warp and weft yarns;

a bottom of the pockets being formed by a plain weave of the warp and weft yarns; and a contact plane of the web facing side comprising elongated warp knuckles, wherein a ratio of a length of warp floats to a length of weft floats is greater than 1:1, and wherein a ratio of a length of warp floats to a length of weft floats is 7:2.

37. A paper making machine fabric comprising:

a woven fabric having a weave pattern which is regularly repeated over a surface;

weft yarns, warp yarns, and recesses or pockets which open upwardly to a paper supporting side of the fabric, wherein in zones spaced over the surface of the fabric;

one of the warp yarns overlays at least five of the weft yarns in direct sequence; and said one warp yarn having an adjacent warp yarn disposed on each side of said one warp yarn, wherein a first of said at least five weft yarns extends under said one warp yarn and over the adjacent warp yarns, a second of said five weft yarns extends under the adjacent warp yarns, a third of said five weft yarns extends over the adjacent warp yarns, a fourth of said five weft yarns extends under the adjacent warp yarns, and a fifth of said five weft yarns extends over the adjacent warp yarns.

38. A paper making machine fabric comprising:

a woven fabric having a weave pattern which is regularly repeated over a surface;

weft yarns, warp yarns, and recesses or pockets which open upwardly to a paper supporting side of the fabric, wherein in zones spaced over the surface of the fabric;

one of the warp yarns overlays at least seven of the weft yarns in direct sequence; and said one warp yarn having an adjacent warp yarn disposed on each side of said one warp yarn, wherein at least three of said at least seven weft yarns extends under said one warp yarn and over the adjacent warp yarns.

39. A paper making machine fabric comprising:

a woven fabric having a weave pattern which is regularly repeated over a surface;

weft yarns, warp yarns, and recesses or pockets which open upwardly to a paper supporting side of the fabric, wherein in zones spaced over the surface of the fabric;

one of the warp yarns overlays at least seven of the weft yarns in direct sequence; and said one warp yarn having an adjacent warp yarn disposed on each side of said one warp yarn, wherein at least five of said at least seven weft yarns extends under said one warp yarn and over the adjacent warp yarns.

40. A paper making machine fabric comprising:

a woven fabric having a weave pattern repeating over a surface;

a pattern square for the repeating pattern containing four warp yarns and eight weft yarns;

warp yarn 1 extending over weft yarns 1-5, under weft yarn 6, over weft yarn 7 and under weft yarn 8;

warp yarn 2 extending under weft yarn 1, over weft yarn 2, under weft yarn 3, over weft yarn 4, under weft yarn 5, over weft yarn 6, under weft yarn 7 and over weft yarn 8;

warp yarn 3 extending over weft yarn 1, under weft yarn 2, over weft yarn 3, under weft yarn 4, and over weft yarns 5-8; and warp yarn 4 extending under weft yarn 1, over weft yarn 2, under weft yarn 3, over weft yarn 4, under weft yarn 5, over weft yarn 6, under weft yarn 7 and over weft yarn 8.

41. A paper making machine fabric comprising:

a woven fabric having a weave pattern repeating over a surface;

a pattern square for the repeating pattern containing four warp yarns and ten weft yarns;

warp yarn 1 extending under weft yarn 1, over weft yarn 2, under weft yarn 3 and over weft yarns 4-10;

warp yarn 2 extending over weft yarn 1, under weft yarns 2-3, over weft yarn 4, under weft yarn 5, over weft yarn 6, under weft yarn 7 and over weft yarn 8;

warp yarn 3 extending over weft yarns 1-5, under weft yarn 6, over weft yarn 7, under weft yarn 8 and over weft yarns 9-10; and warp yarn 4 extending over weft yarn I, under weft yarn 2, over weft yarn 3, under weft yarns 4-5, over weft yarn 6, under weft yarns 7-8, over weft yarn 9 and under weft yarn 10.

42. A paper making machine fabric comprising:

a woven fabric having a weave pattern repeating over a surface;

a pattern square for the repeating pattern containing ten warp yarns and ten weft yarns;

warp yarn 1 extending over weft yarn 1, under weft yarn 2, over weft yarns 3-9 and under weft yarn 10;

warp yarn 2 extending under weft yarn 1, over weft yarn 2, under weft yarns 3-5, over weft yarn 6, under weft yarns 7-9 and over weft yarn 10;

warp yarn 3 extending over weft yarns 1-3, under weft yarn 4, over weft yarn 5, under weft yarn 6 and over weft yarns 7-10;

warp yarn 4 extending under weft yarns 1-3, over weft yarn 4, under weft yarn 5, over weft yarn 6, under weft yarns 7-9 and over weft yarn 10;

warp yarn 5 extending over weft yarns 1-7, under weft yarn 8, over weft yarn 9 and under weft yarn 10;

warp yarn 6 extending under weft yarns 1-3, over weft yarn 4, under weft yarns 5-7, over weft yarn 8, under weft yarn 9 and over weft yarn 10;

warp yarn 7 extending over weft yarn 1, under weft yarn 2, over weft yarn 3, under weft yarn 4 and over weft yarns 5-10;

warp yarn 8 extending under weft yarn 1, over weft yarn 2, under weft yarn 3, over weft yarn 4, under weft yarns 5-7, over weft yarn 8 and under weft yarns 9-10;

warp yarn 9 extending over weft yarns 1-5, under weft yarn 6, over weft yarn 7, under weft yarn 8 and over weft yarns 9-10; and warp yarn 10 extending under weft yarn 1, over weft yarn 2, under weft yarns 3-5, over weft yarn 6, under weft yarn 7, over weft yarn 8 and under weft yarns 9-10.

* * * * *